US012419384B2

(12) United States Patent
Fauconnier

(10) Patent No.: US 12,419,384 B2
(45) Date of Patent: Sep. 23, 2025

(54) SOLE STRUCTURE FOR AN ARTICLE OF FOOTWEAR

(71) Applicant: PUMA SE, Herzogenaurach (DE)

(72) Inventor: Sidney Fauconnier, Nuremberg (DE)

(73) Assignee: PUMA SE, Herzogenaurach (DE)

( * ) Notice: Subject to any disclaimer, the term of this patent is extended or adjusted under 35 U.S.C. 154(b) by 139 days.

(21) Appl. No.: 17/736,811

(22) Filed: May 4, 2022

(65) Prior Publication Data

US 2022/0354214 A1 Nov. 10, 2022

Related U.S. Application Data

(60) Provisional application No. 63/183,954, filed on May 4, 2021.

(51) Int. Cl.
*A43B 13/14* (2006.01)
*A43B 13/18* (2006.01)
*A43B 13/22* (2006.01)

(52) U.S. Cl.
CPC ..... *A43B 13/14* (2013.01); *A43B 13/181* (2013.01); *A43B 13/223* (2013.01)

(58) Field of Classification Search
CPC ..... A43B 13/18; A43B 13/181; A43B 13/223
See application file for complete search history.

(56) References Cited

U.S. PATENT DOCUMENTS 2,124,986 A * 7/1938 Pipes ..... A43B 13/223 36/35 R
4,449,306 A * 5/1984 Cavanagh ..... A43B 5/06 36/35 R
D278,851 S * 5/1985 Austin ..... D2/955
4,620,376 A 11/1986 Talarico, II
4,918,838 A 4/1990 Chang
4,989,349 A * 2/1991 Ellis, III ..... A43B 13/141 36/25 R (Continued)

FOREIGN PATENT DOCUMENTS

CN 105876989 A 8/2016
CN 108477744 A * 9/2018

(Continued)

OTHER PUBLICATIONS

Translation of CN-108477744 (Year: 2018).*

(Continued)

*Primary Examiner* — Ted Kavanaugh
(74) *Attorney, Agent, or Firm* — Quarles & Brady LLP

(57) ABSTRACT

A footwear upper and a sole structure for an article of footwear is provided. The footwear sole can include a forefoot region having a first bottom portion extending between a lateral side and a medial side of the footwear, a heel region having a second bottom portion extending between the lateral side and the medial side of the footwear, and a midfoot region disposed between the heel region and the forefoot region. The second bottom portion can be disposed along an inclined plane defined between the lateral side and the medial side, and the inclined plane rises from the medial side to the lateral side. The first bottom portion is disposed along a reference plane, and the inclined plane is disposed at an angle with respect to the reference plane.

14 Claims, 4 Drawing Sheets

(56) References Cited

U.S. PATENT DOCUMENTS

| | | | | |
|---|---|---|---|---|
| 6,708,426 | B2 * | 3/2004 | Erickson | A43B 13/10 36/102 |
| 7,225,564 | B1 * | 6/2007 | Gillespie | A43B 3/30 36/35 R |
| 8,061,059 | B2 | 11/2011 | Bruce et al. | |
| 8,186,081 | B2 * | 5/2012 | Wilson, III | A43B 23/22 36/76 R |
| 8,505,215 | B2 | 8/2013 | Bruce et al. | |
| 9,179,738 | B2 | 11/2015 | Rustam et al. | |
| 9,364,043 | B2 * | 6/2016 | Cavaliere | A43B 5/001 |
| 9,526,296 | B2 | 12/2016 | Langvin et al. | |
| 10,039,342 | B2 * | 8/2018 | Reinhardt | A43B 7/082 |
| 10,349,700 | B2 | 7/2019 | Amis et al. | |
| 10,441,027 | B2 | 10/2019 | Bartel et al. | |
| 10,448,704 | B2 | 10/2019 | Dupre et al. | |
| 10,548,368 | B2 | 2/2020 | Bartel et al. | |
| 10,743,606 | B2 | 8/2020 | Bartel et al. | |
| 10,743,607 | B2 | 8/2020 | Amis et al. | |
| 10,758,001 | B2 | 9/2020 | Case et al. | |
| 10,798,992 | B2 | 10/2020 | Bartel et al. | |
| 10,806,213 | B2 | 10/2020 | Wawrousek et al. | |
| 10,842,224 | B2 | 11/2020 | Farina et al. | |
| 11,363,853 | B2 * | 6/2022 | Oda | A43B 3/26 |
| 2005/0076536 | A1 * | 4/2005 | Hatfield | A43B 23/027 36/3 R |
| 2005/0262739 | A1 * | 12/2005 | McDonald | A43B 13/16 36/102 |
| 2005/0268487 | A1 | 12/2005 | Ellis, III | |
| 2006/0254093 | A1 * | 11/2006 | Fuchslocher | A43B 13/145 36/103 |
| 2008/0229624 | A1 * | 9/2008 | Mueller | A43B 13/143 36/30 R |
| 2018/0184756 | A1 | 7/2018 | Bartel et al. | |
| 2019/0029364 | A1 | 1/2019 | Lucca | |
| 2019/0365029 | A1 * | 12/2019 | Cross | A43B 13/023 |
| 2019/0373982 | A1 | 12/2019 | Dupre et al. | |
| 2020/0100565 | A1 | 4/2020 | Yoshida et al. | |
| 2020/0107611 | A1 | 4/2020 | Welliver et al. | |
| 2020/0121021 | A1 | 4/2020 | Bartel et al. | |
| 2020/0281309 | A1 | 9/2020 | Nishiura et al. | |
| 2020/0367602 | A1 | 11/2020 | Amis et al. | |
| 2020/0367603 | A1 | 11/2020 | Bartel et al. | |
| 2021/0000215 | A1 | 1/2021 | Wawrousek et al. | |
| 2021/0007439 | A1 | 1/2021 | Bartel et al. | |
| 2021/0052036 | A1 | 2/2021 | Farina et al. | |
| 2022/0132978 | A1 * | 5/2022 | Ueno | B29D 35/122 36/25 R |

FOREIGN PATENT DOCUMENTS

| | | | | |
|---|---|---|---|---|
| EP | 3355737 | A1 | 8/2018 | |
| EP | 2296503 | B1 | 11/2018 | |
| EP | 3487344 | B1 | 11/2019 | |
| EP | 3487345 | B1 | 11/2019 | |
| EP | 3487343 | B1 | 12/2019 | |
| EP | 3487346 | B1 | 5/2020 | |
| EP | 3104733 | B1 | 6/2020 | |
| EP | 3355738 | B1 | 8/2020 | |
| EP | 3692850 | A1 | 8/2020 | |
| EP | 3747299 | A1 | 12/2020 | |
| EP | 3750437 | A1 | 12/2020 | |
| GB | 2456320 | A | 7/2009 | |
| KR | 200378111 | Y1 | 3/2005 | |
| KR | 200409798 | Y1 | 3/2006 | |
| WO | 2005067754 | A1 | 7/2005 | |
| WO | 2009148828 | A2 | 12/2009 | |
| WO | 2015123395 | A1 | 8/2015 | |
| WO | 2017058419 | A1 | 4/2017 | |
| WO | 2017058420 | A1 | 4/2017 | |
| WO | 2018017885 | A1 | 1/2018 | |
| WO | 2018017887 | A1 | 1/2018 | |
| WO | 2018017893 | A1 | 1/2018 | |
| WO | 2018118430 | A1 | 6/2018 | |
| WO | 2018017890 | A9 | 2/2019 | |
| WO | 2019232632 | A1 | 12/2019 | |
| WO | 2020076443 | A1 | 4/2020 | |
| WO | WO-2020202404 | A1 * | 10/2020 | A43B 13/14 |
| WO | 2020261562 | A1 | 12/2020 | |

OTHER PUBLICATIONS

Translation of WO-20202024 (Year: 2020).*

International Search Report with Written Opinion of PCT/IB2022/054138 mailed Jul. 26, 2022 (16 pages).

* cited by examiner

SOLE STRUCTURE FOR AN ARTICLE OF FOOTWEAR

CROSS REFERENCE TO RELATED APPLICATIONS

This application claims the benefit of and priority to U.S. Provisional App. No. 63/183,954, filed on May 4, 2021, which is herein incorporated by reference in its entirety.

REFERENCE REGARDING FEDERALLY SPONSORED RESEARCH OR DEVELOPMENT

Not applicable

SEQUENCE LISTING

Not applicable

BACKGROUND

1. Field of the Invention

The present disclosure relates generally to an article of footwear including a sole structure.

2. Description of the Background

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole assemblies generally extend between a ground surface and the upper. In some examples, the sole structure includes an outsole that provides abrasion-resistance and traction with the ground surface. The outsole may be formed from rubber or other materials that impart durability and wear-resistance, as well as enhancing traction with the ground surface.

The anatomy of a foot includes various bones, joints, and movements that are sensitive to the structure and performance of a foot. For example, this sensitivity can be described as proprioception, also known as a "sixth sense," which involves the perception or awareness of the position and movement of one's body. It is advantageous to design an article of footwear that enhances a person's proprioception by delivering comfort and flexibility in certain areas, rigidity and stiffness where needed, and that accommodates the natural movement and flexion of a foot inside of an article of footwear.

SUMMARY

An article of footwear, as described herein, may have various configurations. The article of footwear may have an upper and a sole structure connected to the upper.

In some aspects, the present disclosure provides an article of footwear having an upper and a sole structure. The sole structure can include a forefoot region having a first bottom portion extending between a lateral side and a medial side of the shoe, a heel region having a second bottom portion extending between the lateral side and the medial side of the shoe, and a midfoot region disposed between the heel region and the forefoot region. The second bottom portion can be disposed along an inclined plane defined between the lateral side and the medial side, and the inclined plane rises from the medial side to the lateral side. The first bottom portion is disposed along a reference plane, and the inclined plane is disposed at an angle with respect to the reference plane.

In some embodiments, the first bottom portion includes a sidewall that curves concavely along the lateral side. In some embodiments, the sidewall of the first bottom portion curves concavely along the medial side. In some embodiments, the second bottom portion includes a sidewall that curves convexly along the lateral side. In some embodiments, the sidewall of the second bottom portion curves convexly along the medial side.

In some embodiments, a first plurality of treads of the first bottom portion are disposed at a first twist angle and a second plurality of treads of the second bottom portion are disposed at a second twist angle that is different from the first twist angle. In some embodiments, the first bottom portion defines a widest portion of the sole structure. In some embodiments, the first bottom portion and the second bottom portion are formed of different materials.

In some aspects, an article of footwear includes a sole structure comprising a medial side that is opposite a lateral side, a midfoot region, a forefoot region including a first outsole having a first bottom portion that is defined between the medial side and the lateral side, the first bottom portion defining a horizontal reference plane, and a heel region including a second outsole having a second bottom portion that is defined between the medial side and the lateral side, wherein the second bottom portion is disposed at an angle with respect to the reference plane of the first bottom portion.

In some embodiments, the first bottom portion is formed of a material having a first density and the second bottom portion is formed of a second material having a second density. In some embodiments, the first density is greater than the second density. In some embodiments, the first bottom portion includes a sidewall that curves concavely along the lateral side. In some embodiments, the sidewall of the first bottom portion curves concavely along the medial side. In some embodiments, the second bottom portion includes a sidewall that curves convexly along the lateral side. In some embodiments, the sidewall of the second bottom portion curves convexly along the medial side.

In some aspects, an article of footwear having a sole structure includes a first portion including a heel region and a second portion including at least a forefoot region. The first portion comprises a convexly-curved sidewall and the second portion comprises a concavely-curved sidewall. The first portion includes a lateral portion extending between a centerline and a lateral side and a medial portion extending between the centerline and a medial side. The lateral portion is angled upward between the centerline and the lateral side a first amount. The second portion includes a medial portion that is angled upward between a centerline and a medial side a second amount. The first amount is larger than the second amount and the medial portion of the first portion is wider than the lateral portion of the first portion. In some embodiments, a first plurality of treads of the first portion are disposed at a first twist angle and a second plurality of treads of the second portion are disposed at a second twist angle that is different from the first twist angle. In some embodiments, the first plurality of treads spaced are apart along the forefoot region, extending between the medial side and the lateral side. The first plurality of treads can extend at a first twist angle with respect to a central plane and the first twist angle may be between 1° and 45°, or between 5° and 30°, or between 10° and 20°.

In some embodiments, the first portion is formed of a material having a first density and the second portion is formed of a second material having a second density. In some embodiments, the first density is less than the second density. In some embodiments, the sidewall of the second portion connects to the lateral portion to form an acute angle. In some embodiments, the first portion is configured to impart pronation through an initial heel strike phase and a midstance phase of a gait cycle. In some embodiments, the second portion defines a greater surface area than a surface area of the first portion.

In some embodiments, the heel region may vary in a height between an upper and a second bottom portion, in a direction along a longitudinal axis between a heel end and the midfoot region. For example, the height may be greatest along a portion of the heel region that is beneath an opening formed in the upper. Further, the height may vary in a lateral direction between the medial side and the lateral side. For example the height may be greater at the medial side and gradually decrease toward the lateral side.

In some embodiments, the heel region may vary in height in multiple directions, such as decreasing from the medial side to the lateral side and also from the heel end to the midfoot region. In some examples, the height may be smallest at the lateral side of the midfoot region. The height may vary as a function of distance from the lateral side or from the longitudinal plane. In some embodiments, the second bottom portion further includes a second plurality of treads extending between the medial side and the lateral side. The second plurality of treads extend from the second bottom portion to an apex that is spaced apart from the second bottom portion. A tread depth may be defined along each of the plurality of treads between the second bottom portion and the apex, and the tread depth may vary from a medial side to a lateral side, or along the heel region in a direction parallel with the longitudinal axis. For example, the tread depth can increase from the medial side to the lateral side, the increase in depth being gradual in some examples or uneven in other examples, or a combination thereof.

BRIEF DESCRIPTION OF THE DRAWINGS

The drawings described herein are for illustrative purposes only of selected configurations and are not intended to limit the scope of the present disclosure.

DETAILED DESCRIPTION OF THE DRAWINGS

Figure 1:
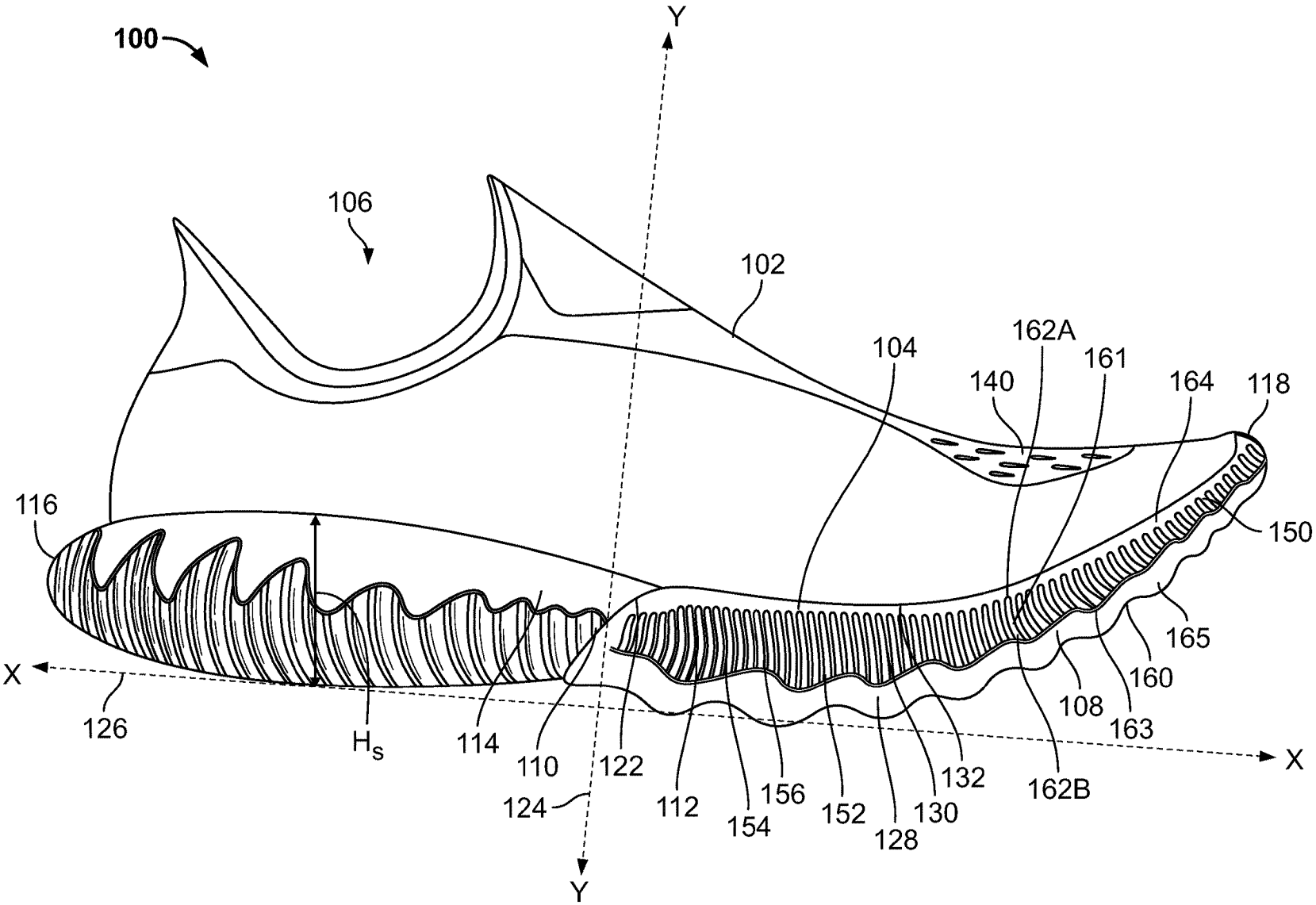
FIG. 1 is a lateral side view of an article of footwear configured as a right shoe that includes an upper and a sole structure.

The following discussion and accompanying figures disclose various embodiments or configurations of a shoe and a sole structure. Although embodiments of a shoe or sole structure are disclosed with reference to a sports shoe, such as a running shoe, tennis shoe, basketball shoe, etc., concepts associated with embodiments of the shoe or the sole structure may be applied to a wide range of footwear and footwear styles, including cross-training shoes, football shoes, golf shoes, hiking shoes, hiking boots, ski and snowboard boots, soccer shoes and cleats, walking shoes, and track cleats, for example. Concepts of the shoe or the sole structure may also be applied to articles of footwear that are considered non-athletic, including dress shoes, sandals, loafers, slippers, and heels.

The term "about," as used herein, refers to variation in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values ±5% of the numeric value that the term precedes.

As used herein in the context of geometric descriptions, unless otherwise limited or defined, "substantially" indicates correspondence to a particular shape or dimension within conventional manufacturing tolerances for components of a similar type or that are formed using similar processes. In this regard, for example, "substantially round" can indicate a profile that deviates from a circle to within acceptable manufacturing tolerances. As used herein, the term "angled" may include a relative position between three points, or two surfaces, axes, planes, or some combination thereof, and may further include linear relationships and non-linear relationships, e.g., curvatures.

Further, as used herein, unless otherwise defined or limited, directional terms are used for convenience of reference for discussion of particular figures or examples. For example, references to "downward," or other directions, or "lower" or other positions, may be used to discuss aspects of a particular example or figure, but do not necessarily require similar orientation or geometry in all installations or configurations.

The terms "first," "second," "third," etc. may be used herein to describe various elements, components, regions, layers and or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

The present disclosure is directed to an article of footwear and/or specific components of the article of footwear, such as an upper and/or a sole or sole structure. The upper may comprise a knitted component, a woven textile, and/or a non-woven textile. The knitted component may be made by knitting of yarn, the woven textile by weaving of yarn, and the non-woven textile by manufacture of a unitary non-woven web. Knitted textiles include textiles formed by way of warp knitting, weft knitting, flat knitting, circular knitting, and/or other suitable knitting operations. The knit textile may have a plain knit structure, a mesh knit structure, and/or a rib knit structure, for example. Woven textiles include, but are not limited to, textiles formed by way of any of the numerous weave forms, such as plain weave, twill weave, satin weave, dobbin weave, jacquard weave, double weaves, and/or double cloth weaves, for example. Non-woven textiles include textiles made by air-laid and/or spun-laid methods, for example. The upper may comprise a variety of materials, such as a first yarn, a second yarn, and/or a third yarn, which may have varying properties or varying visual characteristics.

In addition, the present disclosure relates to footwear having a sole structure that includes a first bottom portion disposed at a first angle with respect to a planar ground surface and a second bottom portion disposed at a second angle with respect to the ground surface, the second angle being different than the first angle. Each of the first bottom portion and the second bottom portion extends laterally from a medial side to a lateral side and includes a first plurality of treads and a second plurality of treads, respectively, extending downwardly therefrom and spaced apart therealong. The first and second plurality of treads extend between the medial side and the lateral side at a first tread angle and a second tread angle, respectively. The first tread angle and the second tread angle may be different from one another. In some examples, the sole structure includes a heel region that is generally rounded between a side portion and the second bottom portion, such that the heel region of the sole structure can interact in a rolling manner with the ground surface. In some examples, the forefoot region includes a toe spring that curves upwardly away from the ground surface, and a first side portion that extends upwardly from the first bottom portion, the first side portion having a concavely curved profile therealong.

FIG. 1 depicts an example of an article of footwear 100 including an upper 102 and a sole structure 104. The upper 102 is attached to the sole structure 104, which includes a toe spring region 108 and a midfoot region 110 that is located between a forefoot region 112 and a heel region 114. The upper 102 and the sole structure 104 together define an interior cavity (not shown) into which a foot may be inserted through an opening 106 that is at least partially located in a heel region 114. The upper 102 includes an insole (not shown) positioned within the interior cavity that may be connected to an interior surface of the footwear 100. The insole may directly contact a user's foot while the shoe is being worn. The sole structure 104 further includes the toe spring region 108 within a portion of the forefoot region 112.

Figure 2:
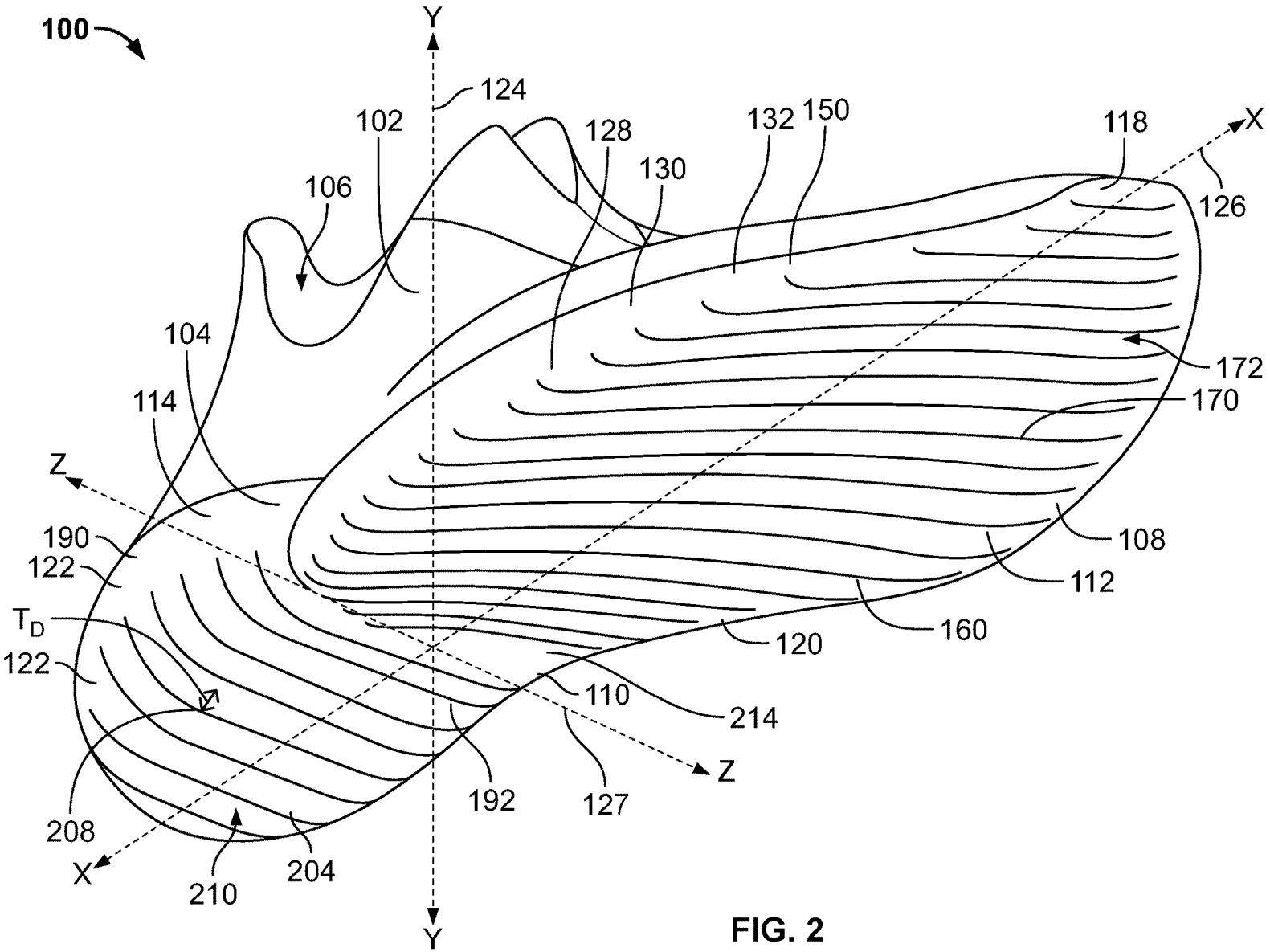
FIG. 2 is an isometric bottom view of another example of an article of footwear that is similar to the article of FIG. 1

For reference, the article of footwear 100 defines a longitudinal axis X that extends longitudinally from a heel end 116 (e.g., adjacent the heel of a user) to a toe end 118 (e.g., adjacent the toes of a user), a vertical Y axis that extends orthogonally relative to the X axis and vertically through the midfoot region 110, and a lateral Z axis (see FIG. 2) that extends perpendicularly relative to the X axis and laterally through the midfoot region 110. The longitudinal axis X is tangent to two lowermost points of the sole structure 104 that are disposed in 1) the heel region 114 or the midfoot region 110, and 2) the forefoot region 112 or the midfoot region 110, and the longitudinal axis X does not pass through any other portion of the sole structure 104. In some embodiments, the vertical Y axis intersects the longitudinal X axis at a midpoint of the article of footwear 100 taken along a length of the longitudinal axis X, and is orthogonal with respect to a ground plane, i.e., a planar surface (not shown), when the article of footwear 100 is resting on the planar surface. A central plane 124 extends in a vertical direction along the Y axis and in a lateral direction along the Z axis, and may intersect the forefoot region 112, the heel region 114, or the midfoot region 110. The central plane 124 may bisect or partition the sole structure 104 into a first portion between the central plane 124 and the toe end 118 and a second portion between the central plane 124 and the heel end 116. A longitudinal plane 126 extends in a longitudinal direction along the X axis and in a vertical direction along the Y axis, such that the longitudinal plane 126 intersects the toe end 118 and the heel end 116 (see, e.g., FIG. 2). The longitudinal plane 126 may constitute a centerline of the sole structure 104. As illustrated in FIG. 2, a lateral plane 127 extends in the lateral direction along the Z axis and in the longitudinal direction along the X axis, and may be coplanar with the two lowermost points that are tangent to the X axis. In some embodiments, the lateral plane 127 is coplanar with the planar surface when the article of footwear 100 is resting on the planar surface.

The forefoot region 112 generally corresponds with portions of the article of footwear 100 that encase portions of the foot that include the toes, the ball of the foot, and joints connecting the metatarsals with the toes or phalanges. The midfoot region 110 is proximate and adjoining the forefoot region 112, and generally corresponds with portions of the article of footwear 100 that encase the arch of the foot, along with the bridge of the foot. The heel region 114 is proximate and adjoining the midfoot region 110 and generally corresponds with portions of the article of footwear 100 that encase rear portions of the foot, including the heel or calcaneus bone, the ankle, and/or the Achilles tendon.

The article of footwear 100 also includes a medial side 120 (e.g., see FIG. 3) and a lateral side 122 (e.g., see FIG. 1). In particular, the lateral side 122 corresponds to an outside portion of the article of footwear 100 and the medial side 120 corresponds to an inside portion of the article of footwear 100. As such, left and right articles of footwear have opposing lateral and medial sides, such that the medial sides 120 are closest to one another when a user is wearing the articles of footwear 100, while the lateral sides 122 are defined as the sides that are farthest from one another while being worn. The medial side 120 and the lateral side 122 adjoin one another at opposing, distal ends of the article of footwear 100.

Unless otherwise specified, the forefoot region 112, the toe spring region 108, the midfoot region 110, the heel region 114, the heel end 116, the toe end 118, the medial side 120, and the lateral side 122 are intended to define boundaries or regions of the article of footwear 100. To that end, the forefoot region 112, the toe spring region 108, the midfoot region 110, the heel region 114, the heel end 116, the toe end 118, the medial side 120, and the lateral side 122 generally characterize sections of the article of footwear 100. Further, both the upper 102 and the sole structure 104 may be characterized as having portions within the forefoot region 112, the toe spring region 108, the midfoot region 110, the heel region 114, the heel end 116, the toe end 118, and on the medial side 120 and the lateral side 122. Therefore, the upper 102 and the sole structure 104, and/or individual portions of the upper 102 and the sole structure 104, may include portions thereof that are disposed within the forefoot region 112, the toe spring region 108, the midfoot region 110, the heel region 114, the heel end 116, the toe end 118, and on the medial side 120 and the lateral side 122.

Figure 4:
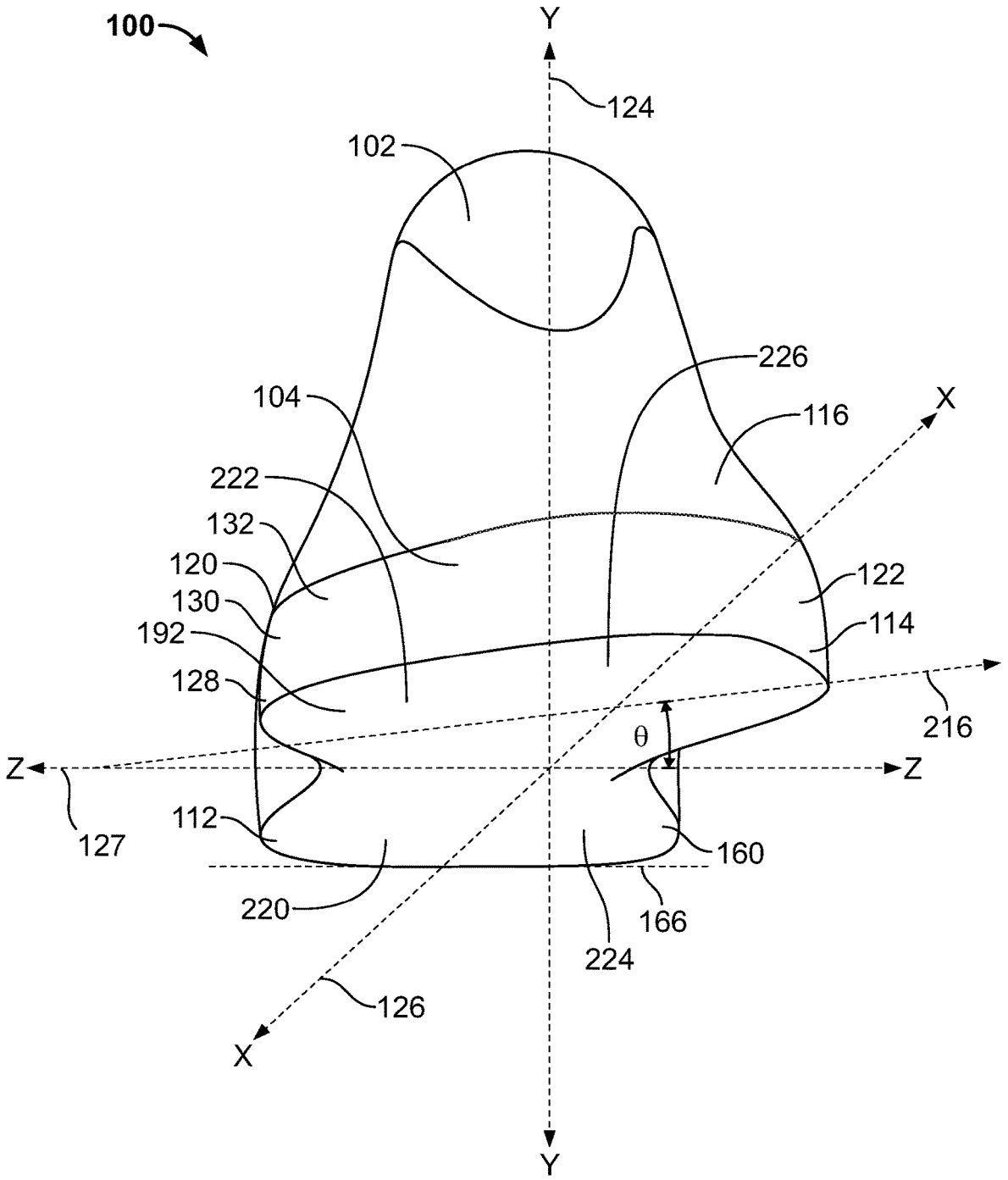
FIG. 4 is a sketch of a rear view of still another example of an article of footwear that is similar to the article of FIG. 1, according to an embodiment of the invention.

Referring to FIG. 4, the sole structure 104 may comprise an outsole region 128 a midsole region 130 and an insole region 132. The outsole region 128, the midsole region 130, and the insole region 132, and/or any components thereof, may include portions within the forefoot region 112, the toe spring region 108, the midfoot region 110, the heel region 114, the heel end 116, and/or the toe end 118. Further the outsole region 128, the midsole region 130, and the insole region 132, and/or any components thereof, may include portions on the medial side 120 or the lateral side 122. In some embodiments, the outsole region 128 may be defined as a portion of the sole structure 104 that at least partially contacts an exterior surface, e.g., the ground, when the footwear 100 is worn. The insole region 132 may be defined as a portion of the sole structure 104 that at least partially contacts a user's foot when the footwear 100 is worn. Finally, the midsole region 130 may be defined as at least a portion of the sole structure 104 that extends between and connects the outsole region 128 with the insole region 132.

Figure 3:
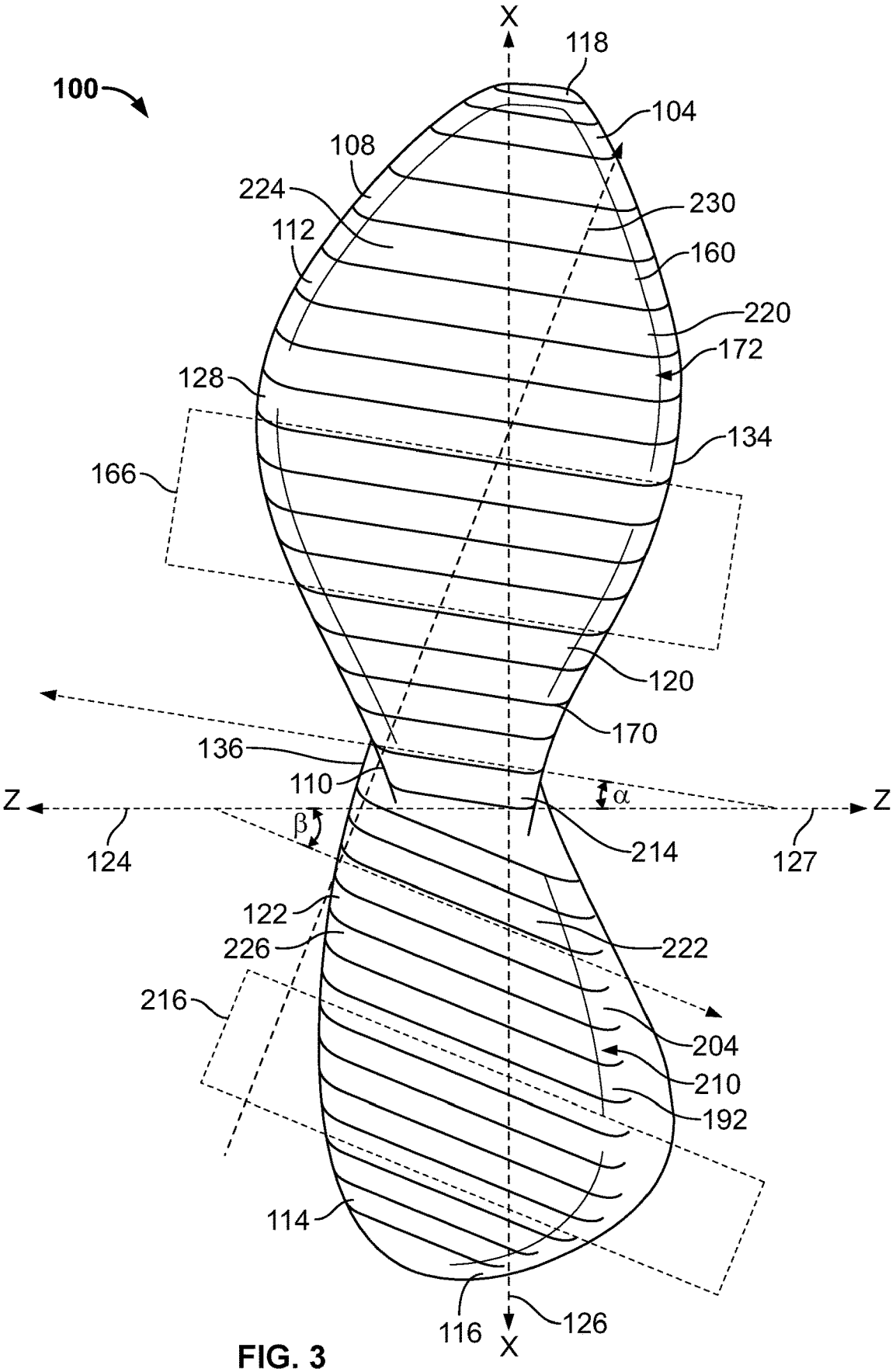
FIG. 3 is a bottom view of yet another example of an article of footwear that is similar to the article of FIG. 1.

Referring to FIG. 3, the forefoot region 112, the midfoot region 110, and the heel region 114 collectively span an entire length of the footwear 100, from the toe end 118 to the heel end 116. The forefoot region 112 extends from the toe end 118 to a widest portion 134 of the footwear 100, i.e., a distance between the medial side 120 and the lateral side 122 of the sole structure 104. The midfoot region 110 extends from the widest portion 134 to a thinnest portion 136 of the footwear 100. The heel region 114 extends from the thinnest portion 136 to the heel end 116 of the footwear 100. Further, the medial side 120 begins at the toe end 118 near the longitudinal plane 126 and bows outward along an inner side of the footwear 100 along the forefoot region 112 toward the midfoot region 110. The medial side 120 reaches the widest portion 134, at which point the medial side 120 bows inward, toward the longitudinal plane 126. That is, the medial side 120 extends from the widest portion 134 of the footwear 100, toward the thinnest portion 136 of the footwear 100. Once reaching the thinnest portion 136 of the footwear 100, the medial side 120 bows outward toward the heel end 116 and terminates near where the longitudinal plane 126 intersects the heel end 116 of the footwear 100.

The lateral side 122 also begins at the toe end 118 of the longitudinal plane 126 and bows outward along an outer side of the footwear 100 (i.e., opposite the inner side) along the forefoot region 112 toward the midfoot region 110. The lateral side 122 reaches the widest portion 134 and bows inward, toward the longitudinal plane 126. That is, the lateral side extends from the widest portion 134 toward the thinnest portion 136. Once reaching the thinnest portion 136, the lateral side 122 extends into the heel region 114 and bows outward, away from the longitudinal plane 126. The lateral side 122 then bows back inward toward the heel end 116, and terminates near where the heel end 116 is intersected by the longitudinal plane 126.

It should be understood that numerous modifications may be apparent to those skilled in the art in view of the foregoing description, and individual components thereof may be incorporated into numerous articles of footwear. Accordingly, aspects of the article of footwear 100 and components thereof, may be described with reference to general areas or portions of the article of footwear 100, with an understanding the boundaries of the forefoot region 112, the midfoot region 110, the heel region 114, the lateral side 122, and/or the medial side 120 as described herein may vary between articles of footwear. Furthermore, aspects of the article of footwear 100 and individual components thereof, may also be described with reference to exact areas or portions of the article of footwear 100 and the scope of the appended claims herein may incorporate the limitations associated with these boundaries of the forefoot region 112, the midfoot region 110, the heel region 114, the lateral side 122, and/or the medial side 120 discussed herein.

Many conventional footwear uppers are formed from multiple elements (e.g., textiles, polymer foam, polymer sheets, leather, and synthetic leather) that are joined through bonding or stitching at a seam. In some embodiments, an upper of an article of footwear according to an embodiment of the invention is formed from a knitted structure or knitted components. In various embodiments, a knitted component may incorporate various types of yarn that may provide different properties to an upper. For example, one area of an upper may be formed from a first type of yarn that imparts a first set of properties, and another area of the upper may be formed from a second type of yarn that imparts a second set of properties. Using this configuration, properties of an upper may vary throughout the upper by selecting specific yarns for different areas of the upper. In the illustrated embodiment, the upper 102 includes a vent section 140 that is disposed near or along the toe spring region 108 within the forefoot region 112, such that the vent section 140 is configured to span portions of the foot that include the toes, the ball of the foot, and joints connecting the metatarsals with the toes or phalanges. The vent section 140 is configured to provide increased airflow exchange between the interior cavity and the ambient environment, which allows for regulation of temperature, moisture, and odors produced during use. To that end, the vent section 140 may be composed of a lightweight, breathable material or material(s) with a plurality of openings or holes, e.g., a mesh structure.

Further, the article of footwear 100 is configured to have a closure mechanism for retaining a user's foot within the interior cavity. In some embodiments, the upper 102 may include a conventional lacing system with eyelets, a finger loop, and a tongue for adjusting the article of footwear 100 to fit around a user's foot. In some embodiments, the upper 102 is formed of an elastic material that is sized and shaped to stretch around a user's foot and exert a compressive force thereon to retain the user's foot in the interior cavity. That is, the upper 102 may include a closure mechanism without conventional lacing, such that the article of footwear 100 is provided as a slip-on or laceless shoe. In some embodiments, the closure mechanism may include a cable that is operatively connected to a reel or disc for adjusting the tightness of the article of footwear 100 around a user's foot. For example, the closure mechanism may be similar to those disclosed in U.S. Pat. Nos. 5,325,613, 5,600,875, 5,606,778, 5,638,588, 5,651,198, and 5,669,116, which are all commonly assigned to Puma SE and incorporated by reference in their entirety herein.

The sole structure 104 is connected or secured to the upper 102 and extends between a foot of a user and the ground when the article of footwear 100 is worn by the user. The sole structure 104 may include one or more components, which may include an outsole, a midsole, a lasting board, a plate, and/or a strobel. For example, in some embodiments, a sole structure 104 may include an outsole that provides structural integrity to the sole structure, along with providing traction for a user, a midsole that provides a cushioning system, and an insole that provides support for an arch of a user. As will be further discussed herein, the sole structure 104 of the present embodiment of the invention includes one or more components that provide the sole structure 104 with preferable performance properties.

Turning again to FIG. 1, a first side portion 150 of the sole structure 104 extends along the forefoot region 112 and the lateral side 122 from the toe end 118 toward the central plane 124, at which point the first side portion 150 may enter the heel region 114 or the midfoot region 110. The first side portion 150 can include surface elements, e.g., a ribbing 152, therealong. In some embodiments, the ribbing 152 can include a plurality of outwardly extending ribs 154 protruding from the first side portion 150 and a plurality of valleys 156 or inwardly protruding recesses formed between the ribs 154. The ribs 154 and the valleys 156 may extend along the midsole region 130 between the upper 102 and the outsole region 128, such that the ribs 154 extend along the first side portion 150. More specifically, the ribs 154 and valleys 156 may extend along the sole structure 104 from the insole region 132 to the outsole region 128 of the forefoot region 112, such that a rib 161 of the plurality of ribs 154 includes a first end 162A that is disposed proximate to the insole region 132 and a second end 162B that is disposed proximate to the first bottom portion 160. The first end 162A is disposed closer to the insole region 132 than the second end 162B. Furthermore, the second end 162B is disposed closer to the first bottom portion 160 than the first end 162A. The first end 162A is disposed closer to the insole region 132 than the second end 162B is to the first bottom portion 160. In other embodiments, the ribs 154 and valleys 156 may extend only along the insole region 132, or only along the outsole region 128, or both.

Further, the first side portion 150 can be curved along a vertical extent relative to the longitudinal plane 126, such that the first side portion 150 defines a concavely curved profile between the insole region 132 and the outsole region 128. The first side portion 150 may have a profile that varies in curvature along the longitudinal axis X between the toe end 118 and the central plane 124, or between the toe end 118 and the midfoot region 110 and/or the heel region 114. For example, the first side portion 150 may define a profile with a larger curvature near the midfoot region 110 or the heel region 114 than the toe end 118. In other examples, the first side portion 150 may have a consistent curvature along the longitudinal axis X, or the first side portion 150 may be convexly curved, or the first side portion 150 may vary between concave and convex curvature, or the first side portion 150 may not be curved.

In some embodiments, the first side portion 150 includes a wave-like shape along the outsole region 128 that varies in amplitude, i.e., height. For example, the amplitude can be greater between the midfoot region 110 and the toe spring region 108 than between the toe spring region 108 and the toe end 118. In some examples, the amplitude is a function of distance from the central plane 124, where the amplitude decreases as the distance from the central plane 124 increases, or vice versa.

With continued reference to FIG. 1, the toe spring region 108 extends toward the central plane 124 to approximately the widest portion 134 within the forefoot region 112. The sole structure 104 curves upward along the toe spring region 108 with respect to the central plane 124, such that the sole structure 104 at the toe end 118 is spaced apart from the ground when the longitudinal axis X of the footwear 100 is parallel with the ground. The sole structure 104 includes a first bottom portion 160 that extends along the outsole region 128 and the forefoot region 112, such as between the toe end 118 and the central plane 124, and between the lateral side 122 and the medial side 120 of the footwear 100. The first side portion 150 connects to the first bottom portion 160 along the outsole region 128, such that the first side portion 150 is perpendicular with respect to the first bottom portion 160 or forms an acute angle therewith.

Additionally, the first side portion 150 includes a contour line 163 that extends from the toe end 118 toward the heel end 116. An upper portion 164 of the first side portion 150 is above the contour line 163. The ribs 154 are disposed in the upper portion 164 of the first side portion 150. A lower portion 165 of the first side portion 150 is between the contour line 163 and the first bottom portion 160. The lower portion 165 is devoid of ribs.

Accordingly, the first side portion 150 and the first bottom portion 160 can form a lever arm with the ground, such that lateral stability is provided to a user making agile movements, e.g., cutting, when the footwear is worn. As illustrated in FIG. 4, the first bottom portion 160 at least partially defines a horizontal reference plane 166 that extends substantially parallel to the ground. In some embodiments, the first bottom portion 160 defines a rise or incline across the outsole region 128 between the lateral side 122 and the medial side 120, or between the medial side 120 and the lateral side 122, such that the horizontal reference plane 166 extends at an angle relative to the ground.

It will be appreciated that the forefoot region 112 of the sole structure 104 includes a portion (not shown) that is disposed along the medial side 120 of the footwear 100 and that may resemble the first side portion 150 in various attributes, e.g., curvature, dimensions, surface elements, appearance, and material. As such, any attributes of the first side portion 150 described herein may be applicable to portions on both the lateral side 122 and the medial side 120 of the footwear 100. However, in some examples the sole structure 104 may substantially differ along the medial side 120 and the lateral side 122 of the footwear 100.

Now referring to FIGS. 2 and 3, the first bottom portion 160 may further include a first plurality of treads 170 spaced apart along the forefoot region 112, extending between the medial side 120 and the lateral side 122, and defining a first plurality of channels 172. The first plurality of treads 170 may be evenly spaced apart along the forefoot region 112, or unevenly spaced apart in select regions thereof, or spaced apart as a function of distance from the central plane 124. The first plurality of channels 172 may extend continuously between the medial side 120 and the lateral side 122, or the first plurality of channels 172 may be interrupted at some point therebetween. The first plurality of treads 170 can extend at a first twist angle $\alpha$ with respect to the central plane 124 and the first twist angle $\alpha$ may be between 1° and 45°, or between 5° and 30°, or even between 10° and 20°.

Further, the first twist angle $\alpha$ may be reversed, such that the first twist angle $\alpha$ may be between −1° and −45°, or between −5° and −30°, or even between −10° and −20°. Further, the article of footwear 100 may be provided with a right shoe and a left shoe that each include the first plurality of treads 170 disposed at different first twist angles $\alpha$, such as, e.g., equal and mirrored to one another, or different from one another, or identical to one another. It is further contemplated that the first plurality of treads 170 may be partially disposed at varying angles with respect to the central plane 124. In some examples, several of the first plurality of treads 170 disposed nearer to the toe end 118 or along the toe spring region 108 may extend at a different first twist angle $\alpha$ than several of the first plurality of treads 170 disposed nearer to the midfoot region 110. In some examples, the first twist angle $\alpha$ may vary as a function of distance from the central plane 124, such that the first twist angle $\alpha$ increases with an increase in distance from the central plane 124. In some examples, the first twist angle $\alpha$ may decrease as a function of distance from the central plane 124.

Referring to FIGS. 1 and 2, a second side portion 190 of the sole structure 104 extends along the heel region 114 and the lateral side 122 from the heel end 116 toward the central plane 124, at which point the second side portion 190 may enter the midfoot region 110 and/or the forefoot region 112.

The second side portion 190 can include surface elements formed thereon that may be continuous between the heel end 116 and the central plane 124 and between the insole region 132 and the outsole region 128. Alternatively, the surface elements may be discontinuous in one or more directions, e.g., between the insole region 132 and the outsole region 128 or between the heel end 116 and the central plane 124. The second side portion 190 can be curved along a vertical extent relative to the longitudinal plane 126, such that the second side portion 190 defines a convexly curved profile between the insole region 132 and the outsole region 128.

The second side portion 190 may vary in curvature along the longitudinal axis X between the heel end 116 and the midfoot region 110 and/or the forefoot region 112. For example, the second side portion 190 may define a larger curved profile near the midfoot region 110 than the heel end 116. In other examples, the second side portion 190 may have a consistently curved profile along the longitudinal axis X, or the second side portion 190 may define a profile that varies between convex and concave curvature, or the second side portion 190 may not be curved. As illustrated in FIG. 3, the heel region 114 of the sole structure 104 is asymmetrical about the longitudinal axis X such that the medial side 120 bows further outwardly from the longitudinal plane 126 than the lateral side 122.

It will be appreciated that the heel region 114 of the sole structure 104 includes a portion (not shown) that is disposed along the medial side 120 of the footwear 100 and that may resemble the second side portion 190 in curvature, dimensions, surface elements, appearance, and material. As such, any attributes of the second side portion 190 described herein may be applicable to portions on both the lateral side 122 and the medial side 120 of the footwear 100. However, in some examples the sole structure 104 may substantially differ along the medial side 120 and the lateral side 122 of the footwear 100.

In addition, a second bottom portion 192 extends from or is attached to a portion of the sole structure 104 along the heel region 114 and the outsole region 128, such as between the heel end 116 and the central plane 124. The second bottom portion 192 also extends between the lateral side 122 and the medial side 120 of the footwear 100. The second bottom portion 192 faces the ground and connects to the second side portion 190 to form a generally curved radius about the longitudinal axis X, such that a convexly curved profile extends from the insole region 132 through the midsole region 130 to the outsole region 128. In some examples, a constant radius of curvature about the longitudinal axis X may be defined along a portion of the second side portion 190 and the second bottom portion 192 between the insole region 132 and the outsole region 128. The radius of curvature may vary along the longitudinal axis X in the heel region 114 between the heel end 116 and the midfoot region 110 or the forefoot region 112. Accordingly, the second bottom portion 192 and the second side portion 190 do not form a lever arm with the ground surface. In this manner, the curved profile of the heel region 114 of the sole structure 104 allows for rotation of the footwear 100, e.g., rolling, about the longitudinal axis X. In combination, the forefoot region 112 and the heel region 114 promote lateral stability by distributing lateral forces along the forefoot region 112 rather than along the heel region 114.

As illustrated in FIG. 1, the heel region 114 may vary in stack height Hs, i.e., a distance between the upper 102 and the second bottom portion 192. For example, the stack height Hs may vary along the X axis between the heel end 116 and the midfoot region 110 and/or the forefoot region 112. Additionally or alternatively, the stack height Hs may be greatest along a portion of the heel region 114 beneath the opening 106, or beneath a location corresponding with an ankle or the calcaneus of a wearer. Further, the stack height Hs may vary along the lateral axis Z between the medial side 120 and the lateral side 122. For example the stack height Hs may be greater at the medial side 120 and gradually decrease toward the lateral side 122, or vice versa. In some examples, the heel region 114 may vary in stack height Hs in multiple directions, such as decreasing from the medial side 120 to the lateral side 122 and also from the heel end 116 to the midfoot region 110. In some examples, the stack height Hs may be smallest at the lateral side 122 of the midfoot region 110. The stack height Hs may vary as a function of distance from the lateral side 122, or from the longitudinal plane L. In some examples the stack height Hs may be greatest halfway between the lateral side 122 and the medial side 120.

Referring to FIGS. 1 and 2, in some examples, the second bottom portion 192 further includes a second plurality of treads 204 extending between the medial side 120 and the lateral side 122. The second plurality of treads 204 extend from the second bottom portion 192 to an apex 208 that is spaced apart from the second bottom portion 192. A tread depth TD may be defined between the second bottom portion 192 and a distal end, i.e., the apex 208, of each of the second plurality of treads 204. The tread depth TD may vary from the medial side 120 to the lateral side 122, or along the longitudinal axis X within the heel region 114. For example, the tread depth TD can increase from the medial side 120 to the lateral side 122, the increase in depth being gradual in some examples or uneven in other examples, or a combination thereof. The second plurality of treads 204 can define a second plurality of channels 210 between each of the second plurality of treads 204. The second plurality of channels 210 can extend continuously from the lateral side 122 to the medial side 120, or the second plurality of channels 210 may be interrupted at some point therebetween.

Referring again to FIGS. 1 and 2, the midfoot region 110 extends between the heel region 114 and the forefoot region 112 to define a third bottom portion 214 that faces the ground during use of the article of footwear 100. The first bottom portion 160 of the forefoot region 112 defines a first surface area, the second bottom portion 192 of the heel region 114 defines a second surface area, and the third bottom portion 214 defines a third surface area. The first surface area is greater than the second surface area and the second surface area is greater than the third surface area. In some examples, the first and second surface areas may be equal, or the second surface area may be larger than the first surface area.

Turning to FIG. 4, the second bottom portion 192 further defines an offset plane 216 that extends at an offset angle θ relative to the lateral plane 127 defined by the lateral axis Z and the longitudinal axis X. The offset plane 216 can be defined along part of the second bottom portion 192, or its entirety. The offset plane 216, or inclined plane, rises continuously (e.g., linearly) in a direction moving from the medial side 120 to the lateral side 122. In other examples, the second bottom portion 192 may define an offset plane 216 that includes a non-linear rise. The offset angle θ may be between 1° and 45°, or between 5° and 30°, or even between 10° and 20°. It is contemplated that the second bottom portion 192 defines the offset plane 216 that rises in a direction moving from the lateral side 122 to the medial side 120. Further, the offset plane 216 may be identical but mirrored between articles of footwear 100 configured as a left shoe and a right shoe. Further, it is contemplated that the offset angle θ may be customized for the left shoe and the right shoe, such that the offset angle θ may of the left shoe may be greater or smaller than the offset angle θ of the right shoe, among other configurations. In some examples, the stack height Hs may correspond with the offset plane 216. For example, the offset plane 216 can be defined by the stack height Hs of the heel region 114 decreasing from the medial side 120 to the lateral side 122. In some examples, the second bottom portion 192 may define an offset plane 216 while the stack height Hs remains constant across the lateral side 122 and the medial side 120.

Referring to FIGS. 2 and 3, the second plurality of treads 204 can extend at an angle with respect to the central plane 124 to define a second twist angle β. The second twist angle β can be between 1° and 45°, or between 5° and 30°, or even between 10° and 20°. Further, the second twist angle β may be reversed, such that the second twist angle β may be between-1° and −45°, or between −5° and −30°, or even between −10° and −20°. Further, the article of footwear 100 may be provided with a right shoe and a left shoe that each include the second plurality of treads 204 disposed at different second twist angles β, such as, e.g., equal and mirrored to one another, or different from one another, or identical to one another. Further, in some examples, there may be a mathematical relationship between the second twist angle β and the offset angle θ depicted in FIG. 4. It is contemplated that a user may be able to customize the sole structure 104 so that the offset angle θ and the second twist angle β are chosen from a predetermined range defined by the mathematical relationship, e.g., a ratio. For example, the second twist angle β may be divided by the offset angle θ to define a stance coefficient. The stance coefficient may correspond to particular activities, user preference, foot anatomy, a material(s) used in the sole structure 104, shoe size, or the like. The stance coefficient may be displayed on the upper 102 or the sole structure 104, whether for marketing purposes or identification.

Referring to FIGS. 3 and 4, the first bottom portion 160 includes a first medial portion 220 extending between the longitudinal plane 126 and the medial side 120 and the second bottom portion 192 includes a second medial portion 222 extending between the longitudinal plane 126 and the medial side 120. Further, the first bottom portion 160 includes a first lateral portion 224 extending between the longitudinal plane 126 and the lateral side 122 and the second bottom portion 192 includes a second lateral portion 226 extending between the longitudinal plane 126 and the lateral side 122. Accordingly, the first medial portion 220 and the first lateral portion 224 are disposed within the forefoot region 112 and the second medial portion 222 and the second lateral portion 226 are disposed within the heel region 114, although other configurations are possible. In the illustrated embodiment, the first medial portion 220, the second medial portion 222, the first lateral portion 224, and the second lateral portion 226 are disposed within the outsole region 128, although other configurations are possible. In some embodiments, at least one the first medial portion 220, the second medial portion 222, the first lateral portion 224, or the second lateral portion 226 extend into the midfoot region 110.

In the illustrated embodiment, the widest portion 134 spans across the first medial portion 220 and the first lateral portion 224. In some embodiments, the first medial portion 220 comprises a greater percentage of the widest portion 134 than the first lateral portion 224. In some embodiments, the first medial portion 220 extends outwardly from the centerline 126 a greater distance than a distance that the first lateral portion 224 extends outwardly from the centerline 126. In some embodiments, the first lateral portion 224 extends outwardly from the centerline 126 a greater distance than a distance that the first medial portion 220 extends outwardly from the centerline 126. In some embodiments, the first lateral portion 224 and the first medial portion 220 are substantially identical and symmetrical about the centerline 126.

In some embodiments, the second medial portion 222 extends outwardly from the centerline 126 a greater distance than a distance that the second lateral portion 226 extends outwardly from the centerline 126. In some embodiments, the second lateral portion 226 extends outwardly from the centerline 126 a greater distance than a distance that the second medial portion 222 extends outwardly from the centerline 126. In some embodiments, the second lateral portion 226 and the second medial portion 222 are substantially identical and symmetrical about the centerline 126. In some embodiments, the second medial portion 222 extends outwardly from the centerline 126 a greater distance than a distance that the first medial portion 220 extends outwardly from the centerline 126.

With reference to FIG. 4, the first medial portion 220 extends substantially horizontal to the ground along the horizontal reference plane 166 near the centerline 126. In addition, the first medial portion 220 curves upwardly, i.e., rises, away from the horizontal reference plane 166 and/or ground as the first medial portion 220 connects to the medial side 120. The first lateral portion 224 extends substantially horizontal to the ground along the horizontal reference plane 166 near the centerline 126. In addition, the first lateral portion 224 curves upwardly, i.e., rises, away from the horizontal reference plane 166 and/or ground as the first lateral portion 224 connects to the lateral side 122. It is contemplated that the entire first medial portion 220 and the entire first lateral portion 224 may extend substantially parallel to the ground along the horizontal reference plane 166. In some embodiments, the first medial portion 220 and the first lateral portion 224 curve upwardly or rise equal amounts that are mirrored about the centerline 126. In some embodiments, the first lateral portion 224 curves upwardly or rises a greater amount than an amount that the first medial portion 220 curves upwardly or rises.

Still referring to FIG. 4, the second medial portion 222 and the second lateral portion 226 at least partially define the offset plane 216, such that both the second medial portion 222 and the second lateral portion 226 are disposed at the offset angle θ relative to the horizontal reference plane 166 and/or the ground. In some embodiments, the second medial portion 222 may be disposed at an angle relative to the offset plane 216, such as, e.g., the second medial portion 222 may curve toward or away from the offset plane 216. To that end, the offset plane 216 may be defined by the second lateral portion 226. In some embodiments, the second lateral portion 226 may be disposed at an angle relative to the offset plane 216, such as, e.g., the second lateral portion 226 may curve toward or away from the offset plane 216. To that end, the offset plane 216 may be defined by the second medial portion 222. In the illustrated embodiment, the second lateral portion rises relative to the horizontal reference plane 166 and/or the ground a greater amount as compared to the first lateral portion 224. Similarly, the second medial portion 222 rises relative to the horizontal reference plane 166 and/or the ground a greater amount as compared to the first medial portion 220.

Referring specifically to FIG. 3, the sole structure 104 may be configured for directional guidance throughout the gait cycle. In some embodiments, the sole structure 104 has a hallux directional guidance, such that the first bottom portion 160 and the second bottom portion 192 are angled toward a hallux area, i.e., where the hallux of the foot is positioned, of the article of footwear 100. To that end, the second bottom portion 192 defines the offset plane 216 to be inclined from the central plane 124 toward the heel end 116 and to be inclined from the medial side 120 to the lateral side 122. In some embodiments, the second bottom portion 192 curves convexly in the lateral direction between the medial side 120 and the lateral side 122, such that the offset plane 216 is tangent and coplanar with a portion of one of the second medial portion 222 or the second lateral portion 226 as the remainder of the second bottom portion 192 curves upward away from the offset plane 216.

In some embodiments, the second bottom portion 192 curves in the longitudinal direction from the heel end 116 toward the thinnest portion 136 in the midfoot region 110, such that the offset plane 216 is curved convexly relative to the lateral plane 127. In some embodiments, the stack height Hs is constant within the heel region 114 as the second bottom portion 192 curves and/or inclines therealong. In some embodiments, the stack height Hs varies within the heel region as the second bottom portion 192 curves and/or inclines therealong. Further, the second twist angle β of the second plurality of treads 204 may be arranged to form a right angle with a vector 230 that extends across the outsole region 128 toward the hallux area. In this way, the second bottom portion 192 is configured to impart pronation through the initial heel strike and the midstance phases of the gait cycle, due to the inclination of the offset plane 216, and to direct frictional forces along the vector 230 toward the hallux, due to the arrangement of the second plurality of treads 204.

Further, the first twist angle α of the first plurality of treads 170 may be arranged to direct frictional forces along the vector 230 toward the hallux area. In addition, the first bottom portion 160 may be generally planar in the lateral direction, such that the horizontal reference plane 166 is substantially parallel to the ground, for maximum contact area between the first bottom portion 160 and the ground. In this way, the first bottom portion 160 is configured to increase the frictional forces directed toward the hallux area through the midstance and toe-off phases of the gait cycle. Further, the first bottom portion 160 may curve upwardly along the forefoot region 112 and the toe spring region 108 to the toe end 118, as illustrated in FIG. 1. In some embodiments, the stack height Hs of the sole structure 104 decreases from the midfoot region 110 to the toe end 118 due to the curvature of the first bottom portion 160. Accordingly, the sole structure 104 is configured to provide a forward roll that may be angled toward the hallux area, further promoting increased propulsion during the toe-off phase of the gait cycle.

Accordingly, the first bottom portion 160 and the second bottom portion 192 of the sole structure 104 may be arranged for an intended or specific directional guidance throughout the gait cycle. In some embodiments, the second bottom portion 192 may define the offset plane 216 to counteract various rotational tendencies, e.g., supination or pronation. In some embodiments, the second bottom portion 192 may define the offset plane 216 and the first bottom portion 160 may define the reference plane 166 to complement one another to accommodate particular arch heights, such as, e.g., flat arches or high arches. In some embodiments, the first plurality of treads 170 and the second plurality of treads 204 may be arranged relative to one another to direct and/or increase propulsion. Further, the tread depth TD may vary along the first plurality of treads 170 and the second plurality of treads 204, such that increasing the tread depth TD in certain locations to provide a spring-like lever for increasing propulsion.

In some examples, the forefoot region 112 and the heel region 114 of the sole structure 104 are formed of different materials, such as foam materials, composites, organosheets, and thermoplastic polymeric materials. Examples of foam materials include ethylene vinyl acetate (EVA) copolymers, polyurethanes, polyethers, and olefin block polymers. The foam materials can also include a single polymeric material or a blend of two or more polymeric materials including a polyether block amide (PEBA) copolymer, an EVA copolymer, a thermoplastic polymer urethane (TPU), and/or an olefin block copolymer. In some embodiments, the first bottom portion 160 is formed of a material having a first density and the second bottom portion 192 is formed of a second material having a second density that is less dense than the first density. That is, the second bottom portion 192 may be formed of less dense material to provide cushioning and flexibility, and the first bottom portion 160 may be formed of a more dense material to provide stability and increased traction.

In some examples, the sole structure 104 includes a plate disposed within a part of the forefoot region 112, the heel region 114, the midfoot region 110, or some combination thereof, as well as within the insole region 132, the midsole region 130, or the outsole region 128, or some combination thereof. For example, the plate may be provided for stability or to provide a spring-like feature that transfers stored energy during use, or to provide localized stiffness for customization to a wearer's foot, or to compensate for foot deformities or irregularities. The plate may be formed from unidirectional tape including at least one of ultra-high molecular weight polyethylene (UHMWPE), carbon fibers, boron fibers, glass fibers, and polymeric fibers. Additionally or alternatively, the plate may be manufactured using fiber sheets or textiles, including multi-axial fabric, or by strands formed from multiple filaments of one or more types of fiber affixed to a substrate. In some examples, the plate may be manufactured by weaving, open reed weaving, knitting, stitching, embroidery, additive manufacturing, thermoforming, injection molding, or any other suitable method. In some embodiments, an orthotic insert or footbed may be provided to correspond to the particular configuration of the sole structure 104, such that the orthotic insert is capable of further counteracting pronation or supination, or to compensate for low arch height, or to provide additional comfort and localized support for particular conditions, such as, e.g., foot deformities, work environment conditions, such as extended periods of standing, and other conditions that may necessitate customized support and comfort.

Further, the first bottom portion 160 or the second bottom portion 192 can include any combination of ground engaging members (e.g., spikes, teeth, and/or barbs) that extend downwardly therefrom to engage with the ground. The spike ground engaging members may vary in size or shape, material, and attachment, e.g., removable or permanently fastened.

In other embodiments, other configurations are possible. For example, certain features and combinations of features that are presented with respect to particular embodiments in the discussion above can be utilized in other embodiments and in other combinations, as appropriate. Further, any of the embodiments described herein may be modified to include any of the structures or methodologies disclosed in connection with other embodiments. Additionally, the present disclosure is not limited to articles of footwear of the type specifically shown. Still further, aspects of the articles of footwear of any of the embodiments disclosed herein may be modified to work with any type of footwear, apparel, or other athletic equipment.

As noted previously, it will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention. The exclusive rights to all modifications which come within the scope of the appended claims are reserved.

I claim:

1. An article of footwear having an upper and a sole structure, the sole structure comprising:

a toe end and a heel end;

an insole region, an outsole region, and a midsole region extending between the insole region and the outsole region;

a medial side that is opposite a lateral side;

a forefoot region, a midfoot region, and a heel region;

a lateral plane that is configured to be coplanar with a planar surface when the article of footwear is resting on the planar surface;

a longitudinal plane that extends from the toe end to the heel end; and a central plane that extends from the medial side to the lateral side, wherein the central plane is perpendicular to the lateral plane and the longitudinal plane, wherein the central plane intersects the midfoot region, wherein the forefoot region has a first bottom portion extending between the lateral side and the medial side, wherein the first bottom portion includes a first plurality of treads that extend linearly from the medial side to the lateral side, wherein the first plurality of treads are longitudinally spaced apart along the first bottom portion, wherein the first plurality of treads are disposed at a first twist angle with respect to the central plane, wherein the heel region has a second bottom portion extending between the lateral side and the medial side, wherein the second bottom portion includes a second plurality of treads that extend linearly from the medial side to the lateral side, wherein the second plurality of treads are disposed at a second twist angle with respect to the central plane, wherein the second bottom portion is disposed along an inclined plane defined between the lateral side and the medial side, wherein the inclined plane rises from the medial side to the lateral side, wherein the inclined plane is disposed at an incline angle with respect to the lateral plane, wherein an absolute value of the incline angle is between 10 degrees and 20 degrees, wherein the first bottom portion and the second bottom portion connect to a sidewall of the sole structure, wherein the sidewall includes a plurality of ribs and a rib of the plurality of ribs includes a first end and a second end, wherein the first end is disposed closer to the insole region than the second end, wherein the second end is disposed closer to the first bottom portion than the first end, and wherein the first end is disposed closer to the insole region than the second end is to the first bottom portion.

2. The article of footwear of claim 1, wherein the second bottom portion connects to a second side portion that curves outwardly relative to the longitudinal plane along the lateral side.

3. The article of footwear of claim 2, wherein the second side portion curves outwardly relative to the longitudinal plane along the medial side.

4. The article of footwear of claim 1, wherein the first twist angle is different than the second twist angle.

5. The article of footwear of claim 1, wherein the first bottom portion defines a widest portion of the sole structure.

6. The article of footwear of claim 1, wherein the first bottom portion and the second bottom portion are formed of different materials.

7. An article of footwear having a sole structure, the sole structure comprising:

a toe end and a heel end;

a medial side that is opposite a lateral side;

a forefoot region;

a midfoot region;

a heel region;

a lateral plane that is configured to be coplanar with a planar surface when the article of footwear is resting on the planar surface;

an insole region, an outsole region, and a midsole region extending between the insole region and the outsole region;

a longitudinal plane that extends from the toe end to the heel end; and a central plane that extends from the medial side to the lateral side, wherein the central plane is perpendicular to the lateral plane and the longitudinal plane, wherein the central plane intersects the midfoot region, wherein the forefoot region includes a first outsole having a first bottom portion that extends between the medial side and the lateral side, the first bottom portion including a first plurality of treads spaced apart therealong and disposed at a first twist angle with respect to the central plane, wherein a heel region includes a second outsole having a second bottom portion that extends between the medial side and the lateral side, wherein the second bottom portion includes a second plurality of treads spaced apart therealong and disposed at a second twist angle with respect to the central plane, wherein the first twist angle and the second twist angle are different, wherein the sole structure includes a sidewall, wherein the sidewall includes a plurality of ribs, wherein a rib of the plurality of ribs includes a first end and a second end, wherein the first end is disposed closer to the insole region than the second end, wherein the second end is disposed closer to the first bottom portion than the first end, and wherein the first end is disposed closer to the insole region than the second end is to the first bottom portion.

8. The article of footwear of claim 7, wherein the first bottom portion is formed of a material having a first density and the second bottom portion is formed of a second material having a second density, wherein the first density is greater than the second density.

9. The article of footwear of claim 7, wherein the second bottom portion connects to the sidewall in the heel region, and wherein the sidewall curves outwardly relative to the longitudinal plane in the heel region.

10. The article of footwear of claim 9, wherein the sidewall curves outwardly relative to the longitudinal plane along the medial side and the lateral side of the heel region.

11. An article of footwear having a sole structure, the sole structure comprising:

a toe end and a heel end;

a medial side that is opposite a lateral side;

a forefoot region, a midfoot region, and a heel region;

a lateral plane that is configured to be coplanar with a planar surface when the article of footwear is resting on the planar surface;

a longitudinal plane that extends from the toe end to the heel end and perpendicular to the lateral plane;

an insole region, an outsole region, and a midsole region extending between the insole region and the outsole region;

a sidewall disposed in the midfoot region; and a plurality of ribs that are disposed on a portion of the sidewall in the forefoot region, the plurality of ribs being spaced apart in a longitudinal direction, wherein the forefoot region includes an outsole having a first portion, wherein the sidewall includes a contour line that extends from the toe end toward the heel end, wherein an upper portion of the sidewall is above the contour line, wherein the plurality of ribs extend along the upper portion of the sidewall, wherein a lower portion is between the contour line and the first portion, and wherein the lower portion is devoid of ribs.

12. The article of footwear of claim 11 wherein the outsole region includes a second portion in the heel region, wherein the first portion is formed of a material having a first density and the second portion is formed of a second material having a second density, wherein the second density is less than the first density.

13. The article of footwear of claim 12, wherein the second portion is configured to impart pronation through an initial heel strike phase and a midstance phase of a gait cycle.

14. The article of footwear of claim 13, wherein the first portion defines a greater surface area than a surface area of the first portion.

* * * * *